US012685894B2

(12) United States Patent
Gao et al.

(10) Patent No.: US 12,685,894 B2
(45) Date of Patent: Jul. 21, 2026

(54) FITNESS BIKE

(71) Applicant: Shenzhen Speediance Living Tech Co., Ltd., Shenzhen (CN)

(72) Inventors: Shifan Gao, Shenzhen (CN); Qilong Wang, Shenzhen (CN); You Wu, Shenzhen (CN)

(73) Assignee: Shenzhen Speediance Living Technology Co., Ltd., Shenzhen (CN)

( * ) Notice: Subject to any disclaimer, the term of this patent is extended or adjusted under 35 U.S.C. 154(b) by 43 days.

(21) Appl. No.: 18/812,791

(22) Filed: Aug. 22, 2024

(65) Prior Publication Data

US 2025/0352848 A1 Nov. 20, 2025

(30) Foreign Application Priority Data

May 15, 2024 (CN) ..... 202410604609.3

(51) Int. Cl.
*A63B 22/06* (2006.01)
*A63B 21/005* (2006.01)
*A63B 71/06* (2006.01)

(52) U.S. Cl.
CPC ..... *A63B 22/0605* (2013.01); *A63B 21/0058* (2013.01); *A63B 71/0622* (2013.01); *A63B 2071/0636* (2013.01)

(58) Field of Classification Search
CPC ..... A63B 22/0605; A63B 21/0058; A63B 71/0622; A63B 2071/0636; A63B 21/225; A63B 24/0087; A63B 2071/0638
See application file for complete search history.

(56) References Cited

U.S. PATENT DOCUMENTS

| | | | | |
|---|---|---|---|---|
| 8,944,968 | B2 * | 2/2015 | Baudhuin | A63B 24/0062 482/8 |
| 9,233,276 | B1 * | 1/2016 | Foley | G09B 5/10 |
| 10,561,877 | B2 * | 2/2020 | Workman | A63B 24/0087 |
| 11,534,654 | B2 * | 12/2022 | Silcock | A63B 24/0062 |
| 11,607,583 | B2 * | 3/2023 | Hawkins, III | A63B 21/225 |
| 11,610,664 | B2 * | 3/2023 | Foley | A63F 13/90 |
| 2003/0171190 | A1 * | 9/2003 | Rice | A63F 13/803 482/57 |

(Continued)

FOREIGN PATENT DOCUMENTS

| | | | | |
|---|---|---|---|---|
| CA | 3162738 | A1 * | 7/2021 | A63B 21/015 |
| CN | 201286951 | Y | 8/2009 | |

(Continued)

*Primary Examiner* — Andrew S Lo
(74) *Attorney, Agent, or Firm* — Morse, Barnes-Brown & Pendleton PC; Sean D. Detweiler, Esq.

(57) ABSTRACT

Provided is a fitness bike. The fitness bike includes a frame, a toggle member and a drive assembly. One end of the toggle member is movably connected to a handlebar of the frame, and the toggle member is capable of being toggled by a hand gripping on the handlebar. The drive assembly is disposed on a body of the frame and includes a load motor, a transmission mechanism and pedals, where a motor shaft of the load motor is drivingly connected to the pedals via the transmission mechanism. In the fitness bike, the load motor is used for providing resistance to simulate resistance received in a riding process, thereby eliminating a traditional flywheel structure, improving safety, lightening a weight and reducing a volume.

15 Claims, 9 Drawing Sheets

(56) References Cited

U.S. PATENT DOCUMENTS

| | | | | |
|---|---|---|---|---|
| 2010/0022354 | A1* | 1/2010 | Fisher | A63B 71/0622 482/8 |
| 2016/0325146 | A1* | 11/2016 | Shin | H04L 67/306 |
| 2019/0358483 | A1* | 11/2019 | Fuchs | B62M 19/00 |
| 2020/0222753 | A1* | 7/2020 | Schranz | A63B 21/025 |
| 2024/0226662 | A1* | 7/2024 | Chamberlain | A63B 22/0605 |
| 2025/0025745 | A1* | 1/2025 | Chung | A63B 21/15 |
| 2025/0135272 | A1* | 5/2025 | Wilfert | A63B 22/0605 |

FOREIGN PATENT DOCUMENTS

| | | | | | |
|---|---|---|---|---|---|
| CN | 203436762 | U | | 2/2014 | |
| CN | 105903154 | A | | 8/2016 | |
| CN | 209204556 | U | | 8/2019 | |
| CN | 110559608 | A | * | 12/2019 | A63B 22/00 |
| CN | 211112387 | U | | 7/2020 | |
| CN | 113028009 | A | | 6/2021 | |
| CN | 220530591 | U | | 2/2024 | |
| TW | M617872 | U | | 10/2021 | |
| WO | WO-2011002302 | A2 | * | 1/2011 | A63B 22/0005 |
| WO | WO-2016191561 | A1 | * | 12/2016 | A63B 22/0605 |

* cited by examiner

FITNESS BIKE

CROSS-REFERENCE TO RELATED APPLICATION(S)

This application claims priority to Chinese Patent Application No. 2024106046093 filed May 15, 2024, the disclosure of which is incorporated herein by reference in its entirety.

FIELD OF THE INVENTION

The present disclosure relates to the technical field of fitness devices, and in particular, to a fitness bike.

BACKGROUND

As people place increasing importance on health and living standards continue to rise, fitness has become an indispensable part of daily life. Bike riding is a very good fitness manner but has a very high requirement for a site. A fitness bike is a riding fitness device for simulating a real bike (for example, a mountain bike or a road racing bike). The fitness bike is widely used in places such as a home, a gym and a park due to a relatively low requirement for an installation site.

A traditional fitness bike generally includes a flywheel, a transmission member and pedals. The flywheel is a heavy, metal disc that is fixed in a front of the fitness bike. The transmission member is generally a chain or a belt. The flywheel is connected to the pedals by the chain or the belt. A user drives the flywheel to rotate by stepping on the pedals. In this process, the flywheel provides resistance, thereby simulating a motion riding state of an outdoor bike.

The flywheel has a characteristic of storing and releasing energy due to the weight and inertia effect of the flywheel. When the user starts to step on the pedals, the flywheel starts to rotate due to power provided at the pedals. However, when the user stops stepping on the pedals, the flywheel does not stop immediately due to the weight and inertia of the flywheel but continues to rotate for a period of time. This structure belongs to a fixed-shift structure, which is very dangerous to the user and easy to injure the user. Moreover, a volume and weight of the entire fitness bike are increased due to a large volume and large weight of the flywheel so that the entire fitness bike is not easy to move. In addition, in an existing fitness bike, resistance provided by a flywheel can be changed to simulate different riding resistances. However, an existing manner of changing the resistance of the flywheel is different from that of a real bike, and a real control operation cannot be simulated, thereby reducing the riding experience of a user.

SUMMARY

An object of the present disclosure is to provide a fitness bike. The fitness bike has high safety, a small volume and a small weight and can simulate the control experience of a real bike so that the riding experience of a user is good.

To achieve this object, the present disclosure adopts the technical solutions below.

A fitness bike includes a frame, a toggle member and a drive assembly. The frame includes a handlebar and a body. One end of the toggle member is movably connected to the handlebar, and the toggle member is capable of being toggled by a hand gripping on the handlebar. The drive assembly is disposed on the body and includes a load motor, a transmission mechanism and pedals, where a motor shaft of the load motor is drivingly connected to the pedals via the transmission mechanism. Stepping on the pedals is capable of driving the motor shaft to rotate, the load motor is configured to provide resistance, and toggling the toggle member is capable of adjusting a magnitude of the resistance.

Preferably, the handlebar includes first handles and second handles, where the toggle member includes a first shift lever disposed on a first handle and a second shift lever disposed on a second handle.

Preferably, the first shift lever is an upshift shift lever, and toggling the first shift lever is capable of increasing the resistance; the second shift lever is a downshift shift lever, and toggling the second shift lever is capable of decreasing the resistance.

Preferably, at least one of the first shift lever and the second shift lever is an upshift/downshift shift lever, where toggling the first shift lever or the second shift lever in a first direction is capable of increasing the resistance, and toggling the first shift lever or the second shift lever in a second direction is capable of decreasing the resistance.

Preferably, the transmission mechanism includes a first multi-wedge wheel, a second multi-wedge wheel and a multi-wedge belt, where the motor shaft is drivingly connected to the first multi-wedge wheel, the pedals are drivingly connected to the second multi-wedge wheel, and the multi-wedge belt is sleeved on the first multi-wedge wheel and the second multi-wedge wheel.

Preferably, the drive assembly further includes a tensioning mechanism, where the tensioning mechanism includes a tensioning wheel, a tensioning bolt and a rotary connector, where one end of the rotary connector is capable of rotating about a first axis, the tensioning wheel is connected to the rotary connector and is pressed against an outer side of the multi-wedge belt, and the tensioning bolt is capable of being pressed against the rotary connector.

Preferably, the drive assembly further includes a mounting member, where an arc-shaped guide recess is disposed on one of the mounting member and the rotary connector, a guide protrusion is disposed on the other, and the guide protrusion is capable of moving in the arc-shaped guide recess.

Preferably, the drive assembly further includes a mounting member, where a movable guide seat is fixed on the mounting member, and the tensioning bolt is movably inserted through the movable guide seat.

Preferably, the frame further includes a head, where a button is disposed on the head, and pressing the button is capable of changing the resistance; and/or the fitness bike further includes a control screen, where touching the control screen is capable of changing the resistance.

Preferably, the button includes an upshift button and a downshift button, where pressing the upshift button is capable of increasing the resistance, and pressing the downshift button is capable of decreasing the resistance; or the button is a gear cycle button, where pressing the gear cycle button is capable of cyclically changing a resistance gear of the load motor.

The present disclosure has the beneficial effects below.

The fitness bike provided in the present disclosure includes the frame, the toggle member and the drive assembly. The frame includes the handlebar and the body. The one end of the toggle member is movably connected to the handlebar, and the toggle member is capable of being toggled by the hand gripping on the handlebar. The drive assembly is disposed on the body and includes the load motor, the transmission mechanism and the pedals, where the motor shaft of the load motor is drivingly connected to the pedals via the transmission mechanism. Stepping on the pedals is capable of driving the motor shaft to rotate, the load motor is configured to provide the resistance, and toggling the toggle member is capable of adjusting the magnitude of the resistance. In the fitness bike, the load motor is used for providing the resistance to simulate resistance received in a riding process, thereby eliminating a traditional flywheel structure, improving the safety, lightening the weight and reducing the volume. Moreover, in the fitness bike, the toggle member is disposed on the handlebar, and the user can toggle the toggle member when gripping a handle, thereby adjusting the magnitude of the resistance provided by the load motor. A manner of switching and controlling a transmission of the real bike is simulated in the manner of adjusting the resistance so that the riding experience of the user is more real, thereby improving the riding experience of the user.

BRIEF DESCRIPTION OF THE FIGURES

These and other characteristics of the present invention will be more fully understood by reference to the following detailed description in conjunction with the attached drawings, in which.

REFERENCE LIST

Figure 1:
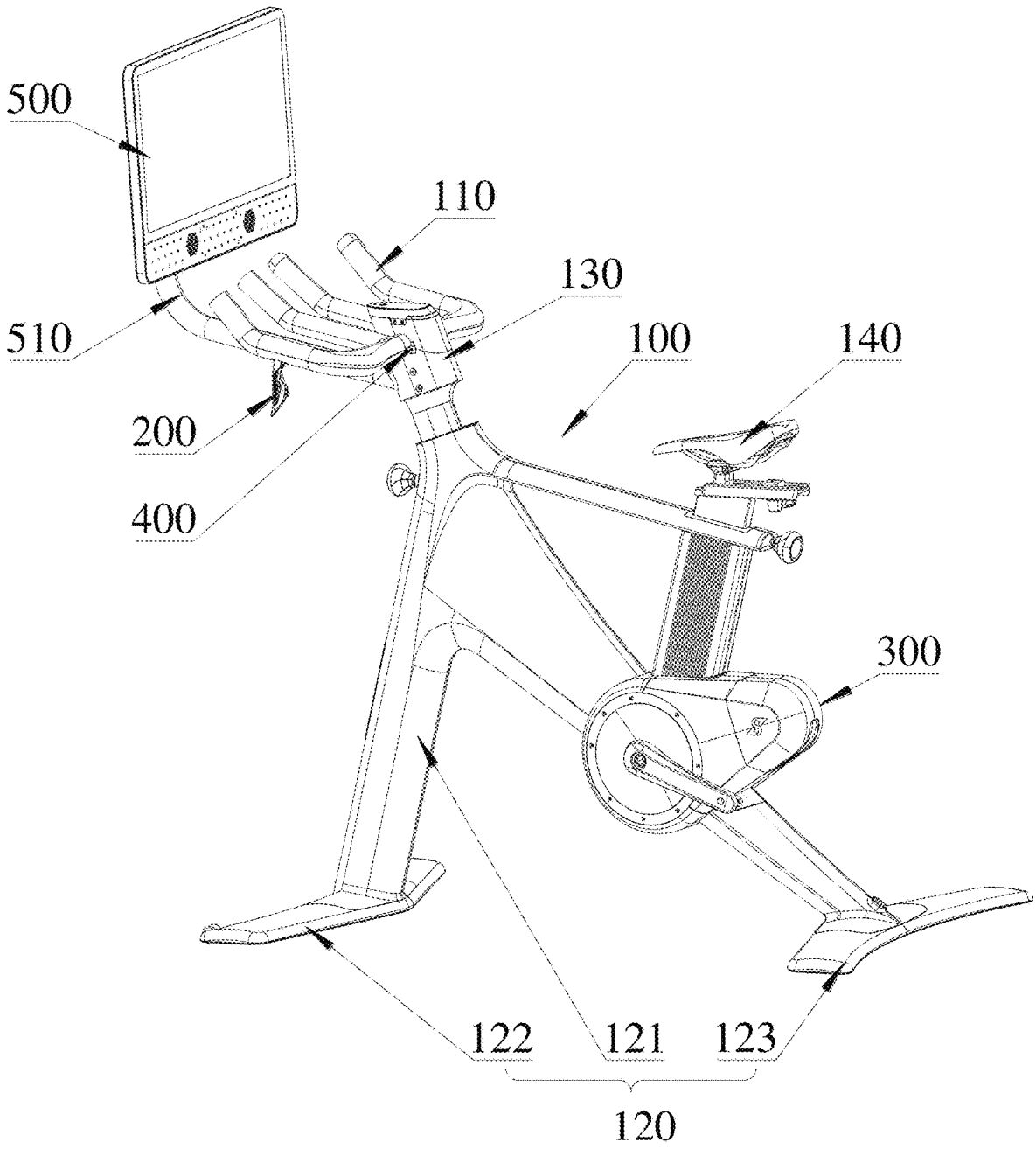
FIG. 1 is a schematic diagram of a fitness bike according to the present disclosure.

100 frame
110 handlebar
111 first handles
112 second handles
120 body
121 main body of the body
1211 first top connection end
1212 first bottom connection end
1213 second bottom connection end
1214 second top connection end
1215 front frame
12151 first frame member
12152 second frame member
12153 beam portion
1216 rear frame
1217 mounting cavity
1218 fixing groove
122 front leg
1221 first front support portion
1222 second front support portion
123 rear leg
1231 first rear support portion
1232 second rear support portion
130 head
140 seat
200 toggle member
210 first shift lever
220 second shift lever
300 drive assembly
310 load motor
320 transmission mechanism
321 first multi-wedge wheel
322 second multi-wedge wheel
323 multi-wedge belt
330 tensioning mechanism
331 tensioning wheel
332 tensioning bolt
333 rotary connector
3331 arc-shaped guide recess
334 guide protrusion
335 movable guide seat
340 housing member
3401 first accommodation cavity
3402 second accommodation cavity
341 first housing
3411 installation space
3412 avoidance through hole
3413 first housing portion
3414 second housing portion
342 second housing
3421 third housing portion
3422 fourth housing portion
343 third housing
344 fourth housing
345 fifth housing
346 fixing protrusion
350 cranks
360 drive plate
370 heat dissipation member
400 button
500 control screen
510 connecting rod
610 first locking member
620 second locking member

DETAILED DESCRIPTION

The present disclosure is further described hereinafter in detail in conjunction with drawings and embodiments. It is to be understood that the specific embodiments set forth below are intended to illustrate and not to limit the present disclosure. In addition, it is to be noted that for ease of description, only part, not all, of the structures related to the present disclosure are illustrated in the drawings.

In the description of the present disclosure, unless otherwise expressly specified and limited, the term "connected to each other", "connected" or "secured" is to be construed in a broad sense, for example, as securely connected, detachably connected or integrated; mechanically connected or electrically connected; directly connected to each other or indirectly connected to each other via an intermediary; or internal connection between two components or an interaction relation between two components. For those of ordinary skill in the art, specific meanings of the preceding terms in the present disclosure may be construed based on specific situations.

In the present disclosure, unless otherwise expressly specified and limited, when a first feature is described as "above" or "below" a second feature, the first feature and the second feature may be in direct contact or be in contact via another feature between the two features. Moreover, when the first feature is described as "on", "above", or "over" the second feature, the first feature is right on, above, or over the second feature, the first feature is obliquely on, above, or over the second feature, or the first feature is simply at a higher level than the second feature. When the first feature is described as "under", "below", or "underneath" the second feature, the first feature is right under, below, or underneath the second feature, the first feature is obliquely under, below, or underneath the second feature, or the first feature is simply at a lower level than the second feature.

In the description of this embodiment, the orientation or position relationships indicated by terms such as "above", "below" and "right" are based on the orientation or position relationships shown in the drawings. These orientations or position relationships are only for ease of description and simplifying an operation and do not indicate or imply that the referred device or element must has a specific orientation and is constructed and operated in a specific orientation. Thus, these orientations or position relationships are not to be construed as limiting the present disclosure. In addition, the terms "first" and "second" are only used for distinguishing between descriptions and have no special meanings.

The present application provides a fitness bike. As shown in FIG. 1 through FIG. 13, the fitness bike includes a frame 100 and a drive assembly 300, where the drive assembly 300 is installed on the frame 100. The frame 100 is a main support structure of the fitness bike and includes a handlebar 110, a head 130, a body 120 and a seat 140. The handlebar 110 is used for being gripped by a user and is connected to or integrally formed on the head 130.

Figure 4:
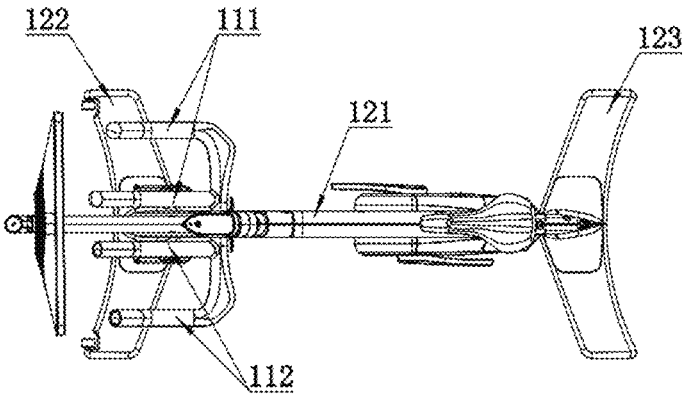
FIG. 4 is a top view of a fitness bike according to the present disclosure.

In some embodiments, the handlebar 110 includes first handles 111 and second handles 112 that are spaced apart from each other on the head 130, where the first handles 111 and the second handles 112 are used for being gripped by both hands of the user, respectively. In some embodiments, one first handle 111 and one second handle 112 are defined as one group, multiple groups are disposed in the fitness bike, and multiple first handles 111 and multiple second handles 112 are spaced apart from each other in a width direction (a left and right direction in FIG. 3) of the fitness bike for different users to select according to body shapes of the users or the same user to adjust a pose according to a requirement. As shown in FIG. 4, in an embodiment, two first handles 111 and two second handles 112 are disposed separately, the spacing between a first handle 111 and a second handle 112 in a first group is relatively small, and a first handle 111 and a second handle 112 in a second group are located on an outer side of the first group so that the spacing between the first handle 111 and the second handle 112 in the second group is relatively large.

In an embodiment, the first handle 111 and the second handle 112 in the first group have the same structure, and each of the first handle 111 and the second handle 112 may be L-shaped and includes a first rod portion and a second rod portion that are connected at an angle, where an end of the first rod portion is connected to the head 130 and is extended forward, and the second rod portion is extended obliquely. In another embodiment, the first handle 111 and the second handle 112 in the second group have the same structure and both include a third rod portion, a fourth rod portion and a fifth rod portion that are connected at an angle, where an end of the third rod portion is connected to the head 130 and is extended to a left side or a right side, the fourth rod portion is extended forward, and the fifth rod portion is extended obliquely. In an embodiment, in a height direction (in an up and down direction shown in FIG. 2), the fourth rod portion is disposed higher than the second rod portion so that a receiving space is formed on a front end of the head 130 by the two groups of first handles 111 and second handles 112, that is, a structure similar to a basket is formed by the two groups of first handles 111 and second handles 112, and an article with a relatively large volume may be placed in the receiving space or hung on an idle first handle 111 or second handle 112 by the user. Of course, in other embodiments, shapes of the first handles 111 and the second handles 112 can be flexibly adjusted according to requirements, as long as the first handles 111 and the second handles 112 are convenient for the user to grip and have relatively beautiful appearances.

Figure 6:
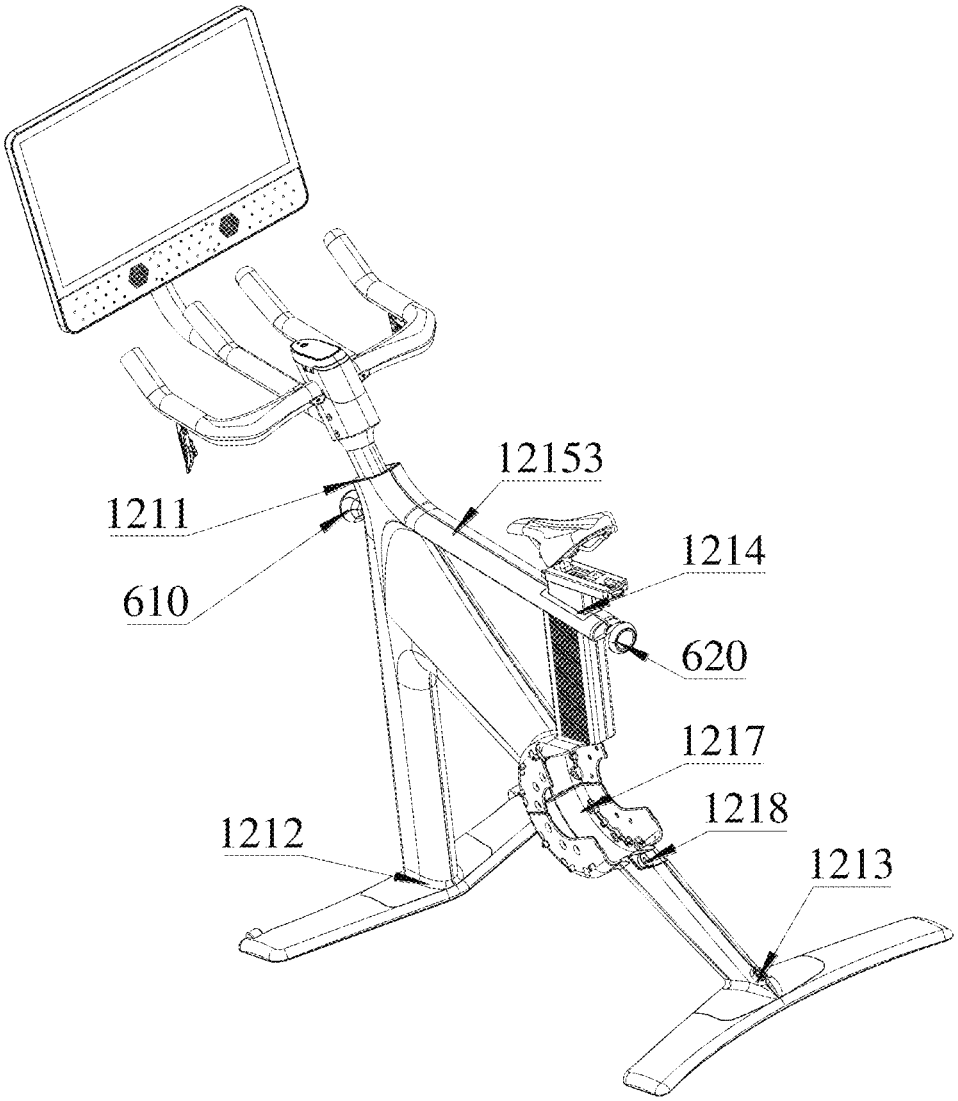
FIG. 6 is a schematic diagram of a fitness bike with a drive assembly removed according to the present disclosure.
Figure 7:
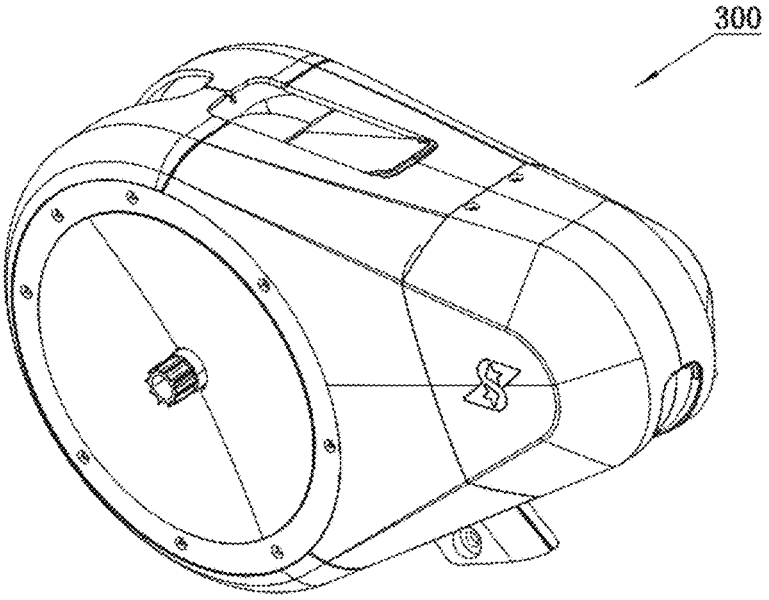
FIG. 7 is a schematic diagram of a drive assembly with pedals and cranks removed according to the present disclosure.

The body 120 includes a main body 121 of the body, a front leg 122 and a rear leg 123. As shown in FIG. 6, the main body 121 of the body includes a first top connection end 1211, a first bottom connection end 1212 and a second bottom connection end 1213, where the first top connection end 1211 is used for being connected to the head 130, the front leg 122 is connected to the first bottom connection end 1212, and the rear leg 123 is connected to the second bottom connection end 1213.

In an embodiment, the head 130 can be connected at the first top connection end 1211 of the main body 121 of the body in a height-adjustable manner. Specifically, a first insertion cavity is disposed at the first top connection end 1211 of the main body 121 of the body, and the head 130 includes a head and a first mounting portion that are connected to each other, where the first mounting portion is movably inserted into the first insertion cavity. To limit the head 130, with continued reference to FIG. 6, the fitness bike further includes a first locking member 610. After a position of the first mounting portion in the first insertion cavity is adjusted in place, the first locking member 610 can lock the first mounting portion with the main body 121 of the body.

Figure 5:
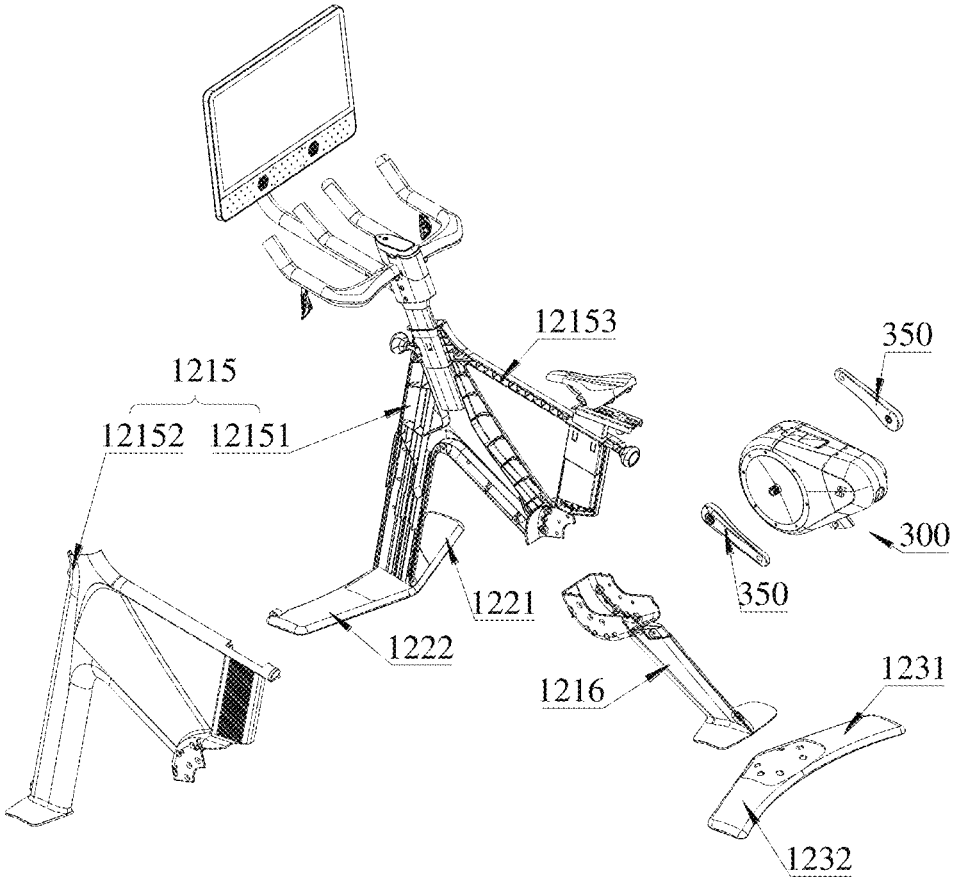
FIG. 5 is an exploded view of a fitness bike according to the present disclosure.

In an embodiment, as shown in FIG. 5, the front leg 122 includes a first front support portion 1221 and a second front support portion 1222 that are connected at an obtuse angle, where an opening of the front leg 122 faces a front of the fitness bike, that is, the front leg 122 is dovetail-shaped. In this manner, not only can a support area of the front leg 122 be increased and the stability of the fitness bike be improved, but also the beauty of the fitness bike can be improved. In one or more embodiments, the front leg 122 is detachably connected to the first bottom connection end 1212, and a manner of detachable connection includes, but is not limited to, screw connection and snap connection.

In an embodiment, the rear leg 123 includes a first rear support portion 1231 and a second rear support portion 1232 that are connected at an obtuse angle, where an opening of the rear leg 123 faces a rear of the fitness bike, that is, the rear leg 123 is dovetail-shaped. In this manner, not only can a support area of the rear leg 123 be increased and the stability of the fitness bike be improved, but also the beauty of the fitness bike can be improved. In one or more embodiments, the rear leg 123 is detachably connected to the second bottom connection end 1213, and a manner of detachable connection includes, but is not limited to, screw connection and snap connection.

With continued reference to FIG. 6, the main body 121 of the body includes a second top connection end 1214, where the second top connection end 1214 is formed in a rear of the first top connection end 1211 for installing the seat 140. In an embodiment, the seat 140 can be connected at the second top connection end 1214 of the main body 121 of the body in a height-adjustable manner. Specifically, a second insertion cavity is disposed at the second top connection end 1214 of the main body 121 of the body, and the seat 140 includes a seat portion and a second mounting portion that are connected to each other, where the second mounting portion is movably inserted into the second insertion cavity. To limit the seat 140, with continued reference to FIG. 6, the fitness bike further includes a second locking member 620. After a position of the second mounting portion in the second insertion cavity is adjusted in place, the second locking member 620 can lock the second mounting portion with the main body 121 of the body.

The main body 121 of the body may be an integrally formed structure, or may be a split structure. With continued reference to FIG. 5, in some embodiments, the main body 121 of the body includes a front frame 1215 and a rear frame 1216, where the above first top connection end 1211, second top connection end 1214 and first bottom connection end 1212 are formed at the front frame 1215, the above second bottom connection end 1213 is formed at the rear frame 1216, and a mounting cavity 1217 where at least a portion of the drive assembly 300 is mounted is formed at a connection between the front frame 1215 and the rear frame 1216. The main body 121 of the body is set as the split structure so that not only is the main body 121 of the body easy to manufacture and easy to transport, but also the drive assembly 300 can be easily installed on the frame 100.

Further, the front frame 1215 includes a first frame member 12151 and a second frame member 12152 that are detachably connected to each other. In an embodiment, the first frame member 12151 and the second frame member 12152 are disposed opposite to each other in the left and right direction of the fitness bike and can be spliced into a whole. In an embodiment, both the first frame member 12151 and the second frame member 12152 are V-shaped. In an embodiment, the second top connection end 1214 is formed by at least one of the first frame member 12151 and the second frame member 12152. In an embodiment, the first top connection end 1211 is formed by at least one of the first frame member 12151 and the second frame member 12152. In an embodiment, the first bottom connection end 1212 is formed by at least one of the first frame member 12151 and the second frame member 12152.

Further, the rear frame 1216 includes a third frame member and a fourth frame member that are detachably connected to each other. In an embodiment, the third frame member and the fourth frame member are disposed opposite to each other in the left and right direction of the fitness bike and can be spliced into a whole. In an embodiment, both the third frame member and the fourth frame member are tapered structures whose widths gradually decrease. In an embodiment, the second bottom connection end 1213 is formed by at least one of the third frame member and the fourth frame member.

In an embodiment, a first arc-shaped plate is connected to or integrally formed on rear ends of both the first frame member 12151 and the second frame member 12152, a second arc-shaped plate is connected to or integrally formed on front ends of both the third frame member and the fourth frame member, and the first arc-shaped plate and the second arc-shaped plate are spliced to form the mounting cavity 1217 shown in FIG. 6.

With continued reference to FIG. 6, the front frame 1215 further includes a beam portion 12153, where the beam portion 12153 is connected or integrally formed between the first top connection end 1211 and the second top connection end 1214. In an embodiment, the beam portion 12153 is formed by at least one of the first frame member 12151 and the second frame member 12152. That is, the beam portion 12153 may be formed by the first frame member 12151 or the second frame member 12152 alone, or the beam portion 12153 may be jointly formed by the first frame member 12151 and the second frame member 12152.

The drive assembly 300 is disposed on the body 120. As shown in FIG. 7 to FIG. 13, the drive assembly 300 includes a load motor 310, a transmission mechanism 320 and pedals (not shown in the figures), where a motor shaft of the load motor 310 is drivingly connected to the pedals via the transmission mechanism 320, stepping on the pedals can drive the motor shaft to rotate, and the load motor 310 is used for providing resistance to the fitness bike. The user can achieve an object of exercise in a process of stepping on the pedals. It is to be noted that the resistance of the load motor 310 can be adjusted. A magnitude of the resistance provided to the user by the load motor 310 is adjusted so that different exercise modes can be provided to the user, thereby achieving different exercise intensities. The larger the resistance is, the larger the exercise intensity is, and the smaller the resistance is, the smaller the exercise intensity is.

Compared with the related art where a flywheel structure is used in a fitness bike for providing a load and resistance so that relatively poor safety and relatively great difficulty in adjusting the resistance are caused, in the fitness bike provided in the present disclosure, the load motor 310 is used for providing the resistance to simulate resistance received in a riding process, thereby eliminating a traditional flywheel structure, improving safety, lightening a weight and reducing a volume. Moreover, the difficulty in adjusting the resistance is reduced, as long as a corresponding electric signal is input to the load motor 310.

In some embodiments, the transmission mechanism 320 is a belt transmission structure and specifically includes a first multi-wedge wheel 321, a second multi-wedge wheel 322 and a multi-wedge belt 323, where the motor shaft is drivingly connected to the first multi-wedge wheel 321, the pedals are drivingly connected to the second multi-wedge wheel 322, and the multi-wedge belt 323 is sleeved on the first multi-wedge wheel 321 and the second multi-wedge wheel 322.

In an embodiment, the pedals are drivingly connected to an axle of the second multi-wedge wheel 322 by cranks 350. Two pedals are disposed on left and right sides of the frame 100, respectively, and are drivingly connected to two ends of the axle of the second multi-wedge wheel 322 by one crank 350, respectively. Of course, in other embodiments, the belt transmission structure may also be composed of a traditional flat belt and flat belt wheel that do not have slots. Compared with the traditional flat belt, the multi-wedge belt 323, which has relatively good flexibility, a relatively large contact surface with the multi-wedge wheels, a relatively thin belt and good deflection, is applicable to a relatively small belt wheel and a high-speed occasion. In addition to the belt transmission structure, the transmission mechanism 320 may also be a chain wheel structure.

In some embodiments, a diameter of the first multi-wedge wheel 321 is less than a diameter of the second multi-wedge wheel 322, and a circumference ratio of the first multi-wedge wheel 321 to the second multi-wedge wheel 322 may be selected from 1:2, 1:2.5, 1:3, 1:3.5, 1:4, 1:5 and 1:6 according to a requirement to improve the universality of the fitness bike. It is to be noted that a multi-wedge wheel group with a required circumference ratio may be selected in advance. After selection and assembly, a ratio of a circumference of the first multi-wedge wheel 321 to a circumference of the second multi-wedge wheel 322 is fixed. The load motor 310 can provide the resistance to the fitness bike, and the resistance output by the load motor 310 can be increased via the transmission mechanism 320 composed of the first multi-wedge wheel 321, the second multi-wedge wheel 322 and the multi-wedge belt 323 when transferred to the pedals.

To adjust a degree of tensioning of the multi-wedge belt 323, the drive assembly 300 further includes a tensioning mechanism 330, where the tensioning mechanism 330 includes a tensioning wheel 331, a tensioning bolt 332 and a rotary connector 333, where one end of the rotary connector 333 can rotate about a first axis, the tensioning wheel 331 is connected to the rotary connector 333 and is pressed against an outer side of the multi-wedge belt 323, and the tensioning bolt 332 can be pressed against the rotary connector 333. The tensioning mechanism 330 is disposed, thereby avoiding a slip phenomenon of the multi-wedge belt 323.

In some embodiments, the rotary connector 333 is a triangular plate. A first rotating shaft hole is disposed on a first end of the triangular plate, a first rotating shaft member is disposed through the first rotating shaft hole, and a central axis of the first rotating shaft member is the first axis. The tensioning wheel 331 is installed on a second end of the triangular plate. In one or more embodiments, the tensioning wheel 331 is rotatably connected to the second end of the triangular plate. In an embodiment, a second rotating shaft hole is disposed on the second end of the triangular plate, and an axle of the tensioning wheel 331 is rotatably connected to the second rotating shaft hole. In another embodiment, a second rotating shaft member is protruded on the second end of the triangular plate, and the tensioning wheel 331 is rotatably sleeved on the second rotating shaft member.

In some embodiments, the drive assembly 300 further includes a mounting member, where a guide protrusion 334 is disposed on the mounting member, an arc-shaped guide recess 3331 is disposed on the rotary connector 333, and the guide protrusion 334 is disposed in the arc-shaped guide recess 3331 and can move in the arc-shaped guide recess 3331 to provide guidance and limitation for the rotary connector 333 to rotate about the first axis, thereby improving the stability of the rotation. Of course, in other embodiments, the arc-shaped guide recess 3331 may also be disposed on the mounting member, and the guide protrusion 334 may also be disposed on the rotary connector 333. In an embodiment, the arc-shaped guide recess 3331 is an arc-shaped hole. In another embodiment, the arc-shaped guide recess 3331 is an arc-shaped groove.

When the rotary connector 333 rotates until the tensioning wheel 331 provides sufficient tension to the multi-wedge belt 323, the tensioning bolt 332 is pressed against the rotary connector 333 to achieve an object of limiting the rotary connector 333, thereby avoiding the reverse rotation of the limited rotary connector 333. In some embodiments, the drive assembly 300 further includes a movable guide seat 335, where the movable guide seat 335 is disposed on the mounting member, and the tensioning bolt 332 is movably inserted through the movable guide seat 335. In one or more embodiments, a threaded hole is disposed on the movable guide seat 335, and the tensioning bolt 332 is connected to the threaded hole through threaded connection. Of course, in other embodiments, the tensioning bolt 332 may also be rotatably connected to the mounting member. The tensioning bolt 332 is rotated so that the tensioning bolt 332 is switched between a position where the rotary connector 333 is limited and a position where the rotary connector 333 is avoided.

Figure 8:
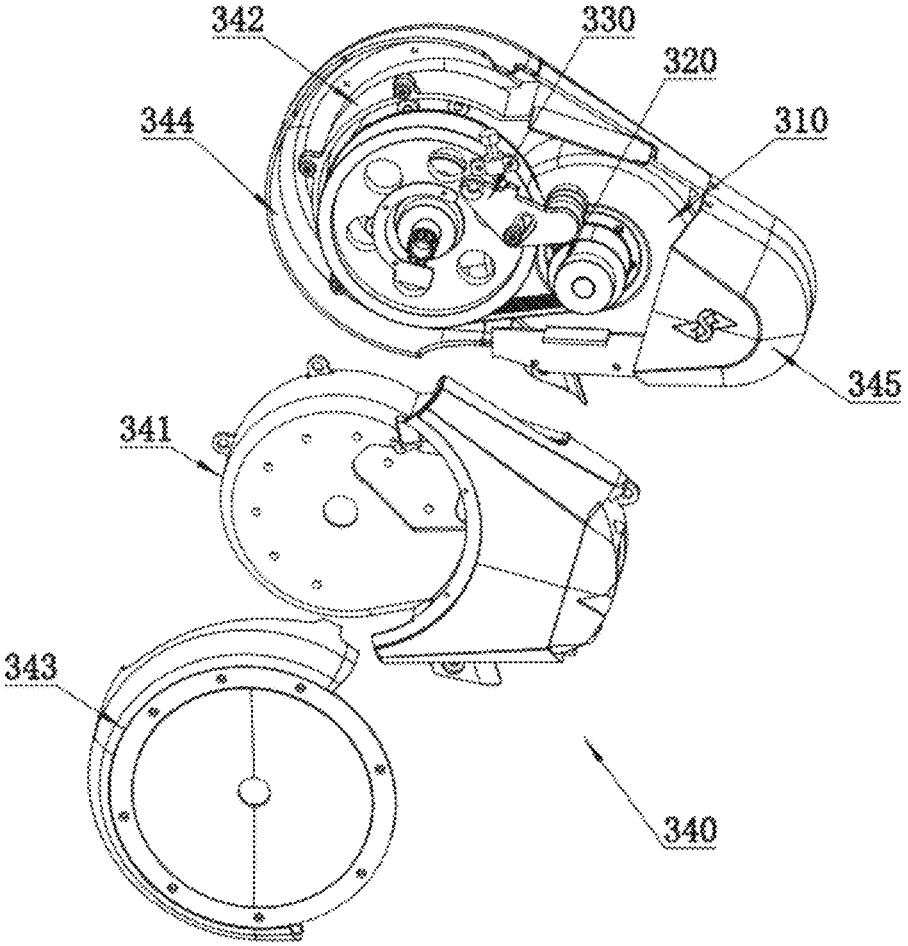
FIG. 8 is a first exploded view of the structure shown in FIG. 7.

With continued reference to FIG. 8, the drive assembly 300 further includes a housing member 340, where the housing member 340 covers outer sides of the load motor 310 and the transmission mechanism 320 to provide protection to the load motor 310 and the transmission mechanism 320, and both the pedals and the cranks 350 are disposed on an outer side of the housing member 340 to facilitate the user to step on.

In some embodiments, the housing member 340 includes a first housing 341 and a second housing 342, where the first housing 341 and the second housing 342 are spliced to form at least a portion of the housing member 340, and the first housing 341 can be detachably connected to the second housing 342 by structures such as a connector and a snap. In an embodiment, with continued reference to FIG. 8, the first housing 341 and the second housing 342 cover on the outside of the load motor 310 and the transmission mechanism 320 from the left and right sides, respectively, and an axle hole for the axle of the second multi-wedge wheel 322 to pass through is disposed through each of the first housing 341 and the second housing 342. In another embodiment, the first housing 341 and the second housing 342 cover on the outside of the load motor 310 and the transmission mechanism 320 from upper and lower sides, respectively. In another embodiment, the first housing 341 and the second housing 342 cover on the outside of the load motor 310 and the transmission mechanism 320 from front and rear sides, respectively.

Figure 13:
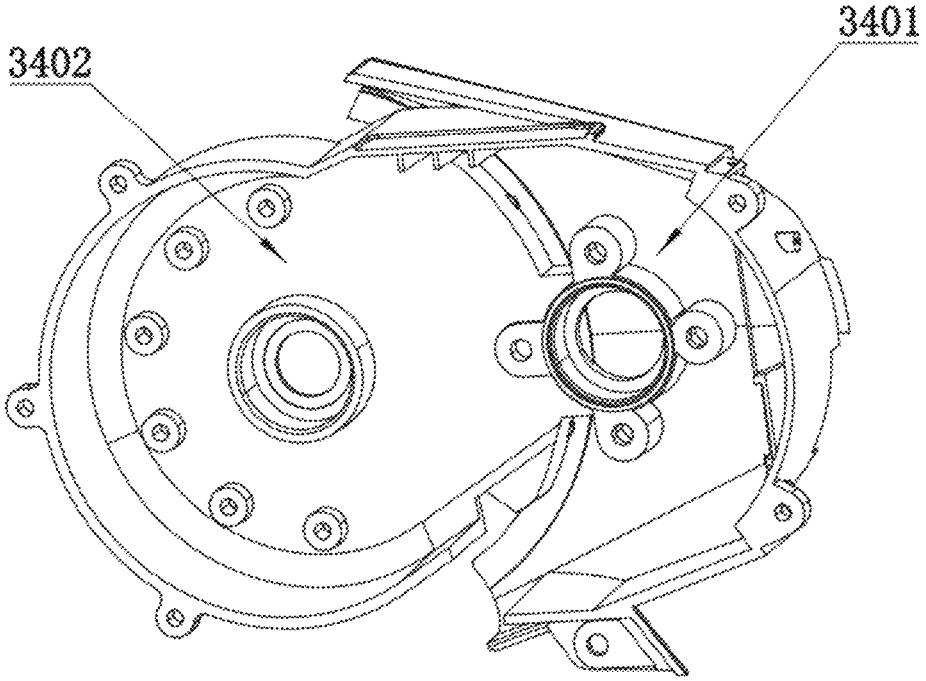
FIG. 13 is a schematic diagram of a second housing at another viewing angle according to the present disclosure.

In some embodiments, as shown in FIG. 13, a first accommodation cavity 3401 and a second accommodation cavity 3402 are formed in the housing member 340, the load motor 310 and the first multi-wedge wheel 321 are disposed in the first accommodation cavity 3401, and the second multi-wedge wheel 322 is disposed in the second accommodation cavity 3402. This facilitates the assembly of the housing member 340 with the load motor 310, the first multi-wedge wheel 321 and the second multi-wedge wheel 322.

Figure 11:
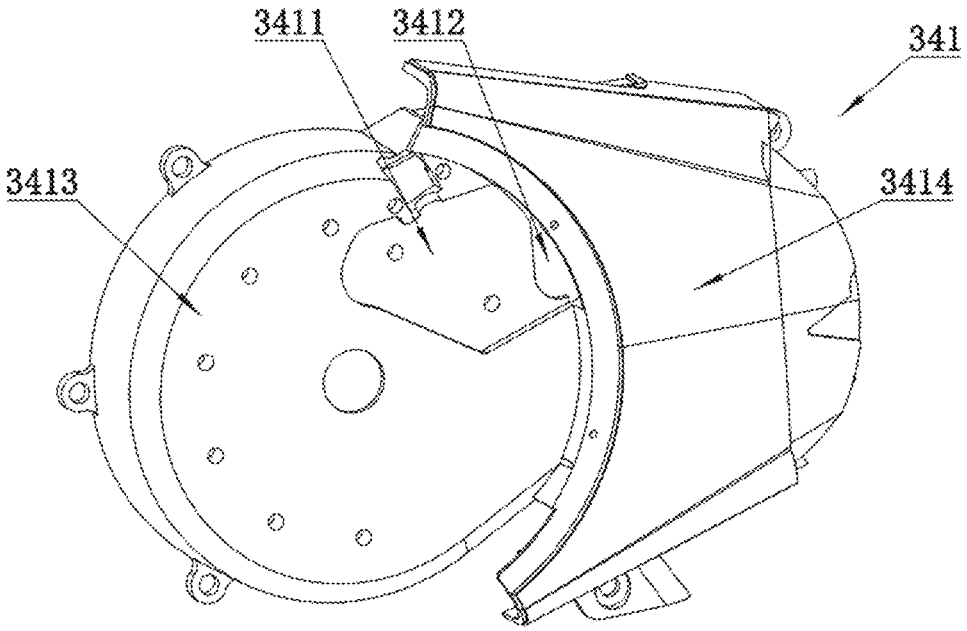
FIG. 11 is a schematic diagram of a first housing according to the present disclosure.

The first housing 341 and the second housing 342 may have the same structure or different structures. Since the tensioning mechanism 330 is disposed on a side of the transmission mechanism 320, to facilitate the installation of the tensioning mechanism 330 and to improve the structural compactness of the drive assembly 300, the first housing 341 or the second housing 342 is used as the above mounting member. As shown in FIG. 11, an installation space 3411 for installing the tensioning mechanism 330 is formed on an outer side of the first housing 341, and both the tensioning bolt 332 and the rotary connector 333 are placed in the installation space 3411. Moreover, an avoidance through hole 3412 that is connected to the installation space 3411 and runs through the first housing 341 is disposed on the first housing 341, and the tensioning wheel 331 passes through the avoidance through hole 3412 to the multi-wedge belt 323.

Figure 12:
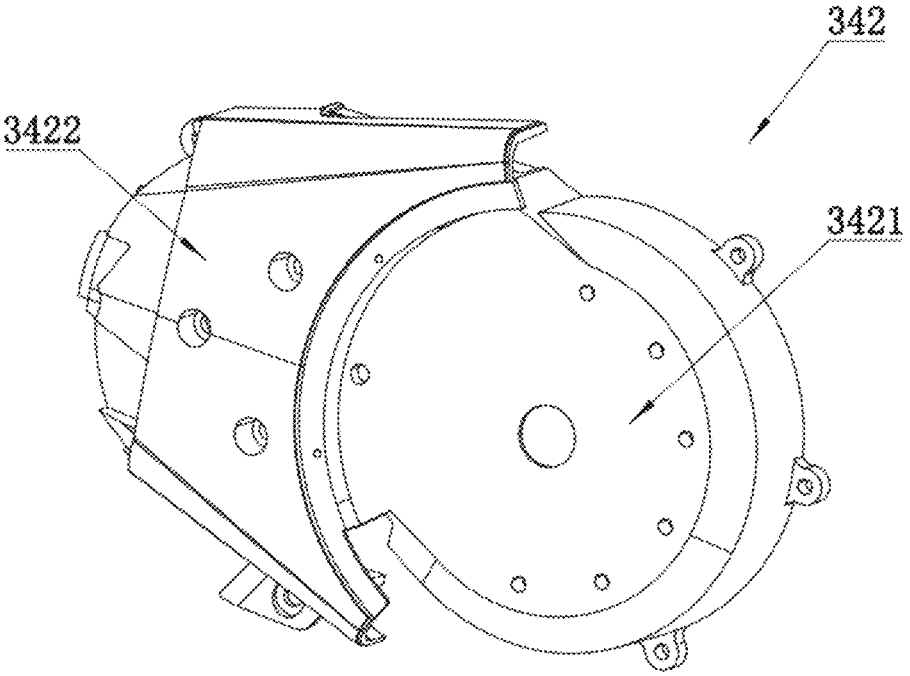
FIG. 12 is a schematic diagram of a second housing at a certain viewing angle according to the present disclosure.

Further, with continued reference to FIG. 11, the first housing 341 includes a first housing portion 3413 and a second housing portion 3414 that are connected to each other, where the first housing portion 3413 is basically in a shape of a circular housing and is mainly used for forming a portion of the second accommodation cavity 3402, and the second housing portion 3414 is a heterogeneous structure and is mainly used for forming a portion of the first accommodation cavity 3401. The installation space 3411 is formed on the first housing portion 3413, and the avoidance through hole 3412 is disposed at a connection between the first housing portion 3413 and the second housing portion 3414. As shown in FIG. 12 and FIG. 13, the second housing 342 includes a third housing portion 3421 and a fourth housing portion 3422 that are connected to each other, where the third housing portion 3421 has the same shape as the first housing portion 3413, a difference lies only in that no installation space 3411 and avoidance through hole 3412 are formed on the second housing 342, and the fourth housing portion 3422 has the same shape as the second housing portion 3414.

With continued reference to FIG. 8, to protect the tensioning mechanism 330 and to improve the beauty of the entire drive assembly 300, the housing member 340 further includes a third housing 343 and a fourth housing 344, where the third housing 343 covers on an outside of the first housing portion 3413 and is completely spliced with the second housing portion 3414, and the fourth housing 344 covers on an outside of the third housing portion 3421 and is completely spliced with the fourth housing portion 3422.

Figure 9:
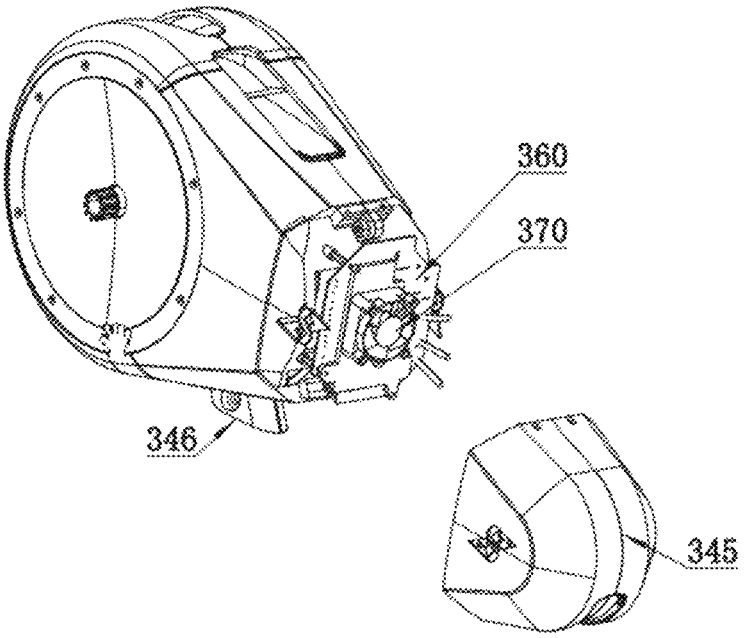
FIG. 9 is a second exploded view of the structure shown in FIG. 7.
Figure 10:
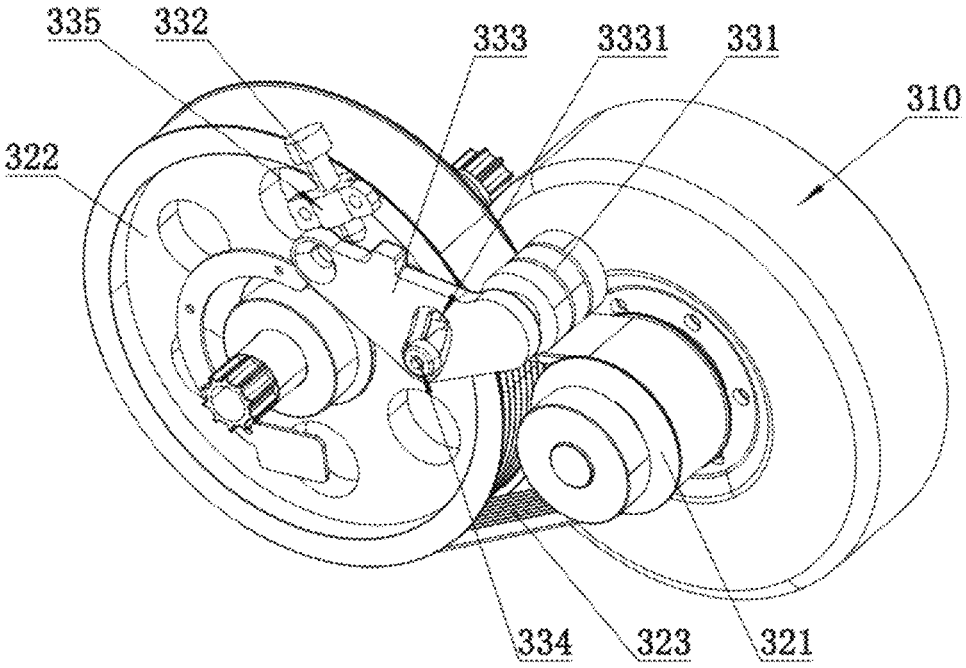
FIG. 10 is a schematic diagram of a load motor, a transmission mechanism, and a tensioning mechanism according to the present disclosure.

With continued reference to FIG. 9, the housing member 340 further includes a fifth housing 345, where the fifth housing 345 is disposed on rear ends of the first housing 341 and the second housing 342, a third accommodation cavity is formed in the fifth housing 345, and a drive plate 360 for controlling the load motor 310 is disposed in the third accommodation cavity. In addition to the drive plate 360, a heat dissipation member 370 for dissipating heat from the drive plate 360 may be further disposed in the third accommodation cavity and may be a heat dissipation fan. In an embodiment, the second housing portion 3414 of the first housing 341, the fourth housing portion 3422 of the second housing 342, the third housing 343, the fourth housing 344 and the fifth housing 345 are spliced to form the shape shown in FIG. 7, and the shape has high beauty.

In an embodiment, the first housing portion 3413 of the first housing 341 and the third housing portion 3421 of the second housing 342 are spliced to form a structure partially placed and fixed in the mounting cavity 1217 formed by the front frame 1215 and the rear frame 1216. A fixing manner may be connector fixing or snap fixing. The third housing 343 and the fourth housing 344 are spliced to form a structure where a slot-shaped structure for avoiding the frame 100 is formed. In this manner, a structure obtained after the drive assembly 300 and the frame 100 are assembled is compact and has high stability.

Further, to improve the stability of the drive assembly 300 on the frame 100, a fixing protrusion 346 is further disposed on a lower side of the housing member 340, and a fixing groove 1218 is formed on the rear frame 1216. The fixing protrusion 346 is limited and fixed in the fixing groove 1218. A fixing manner may be connector fixing or snap fixing. In an embodiment, the fixing protrusion 346 is formed by at least one of the second housing portion 3414 of the first housing 341 and the fourth housing portion 3422 of the second housing 342.

Figure 2:
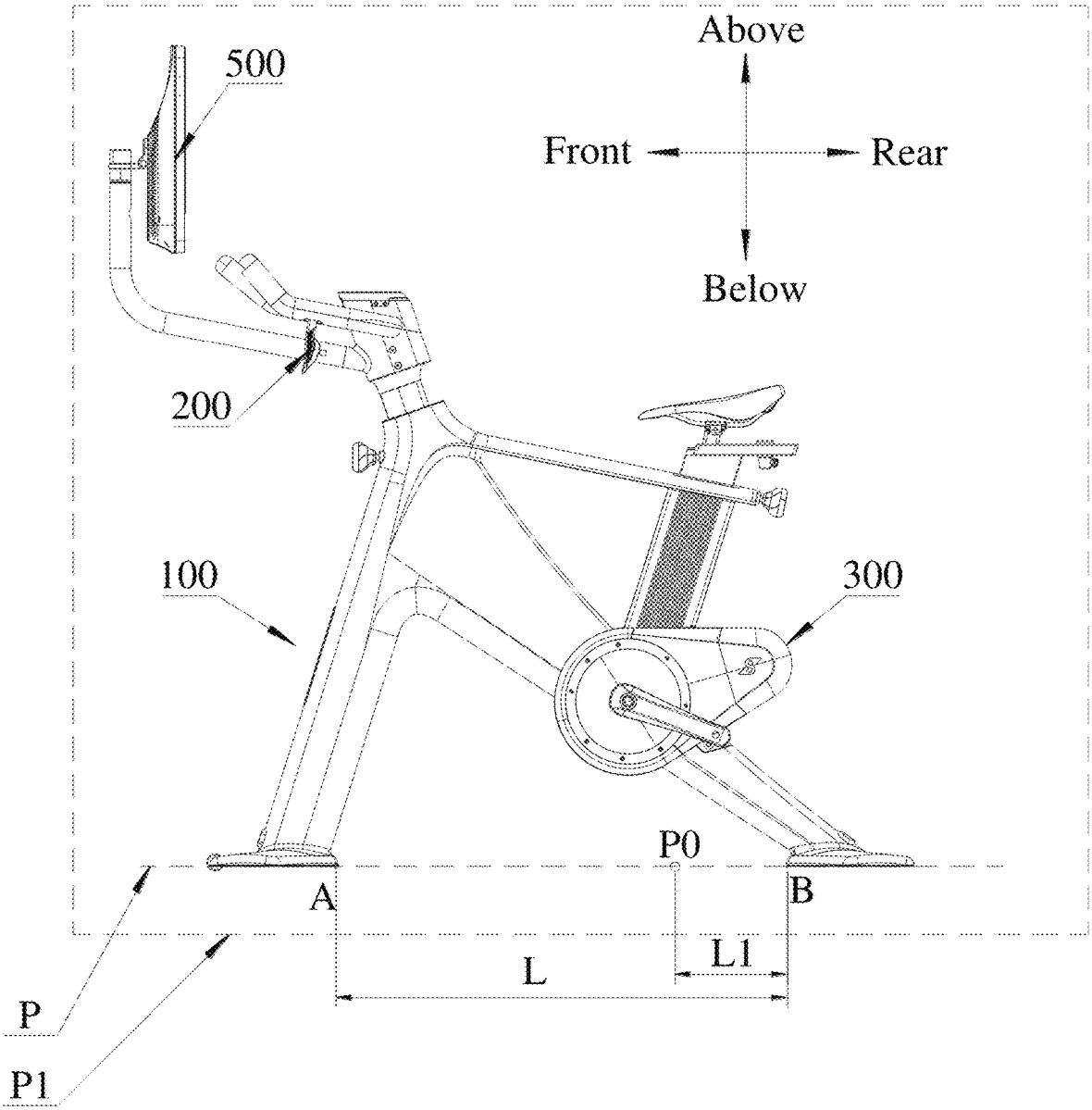
FIG. 2 is a front view of a fitness bike according to the present disclosure.
Figure 3:
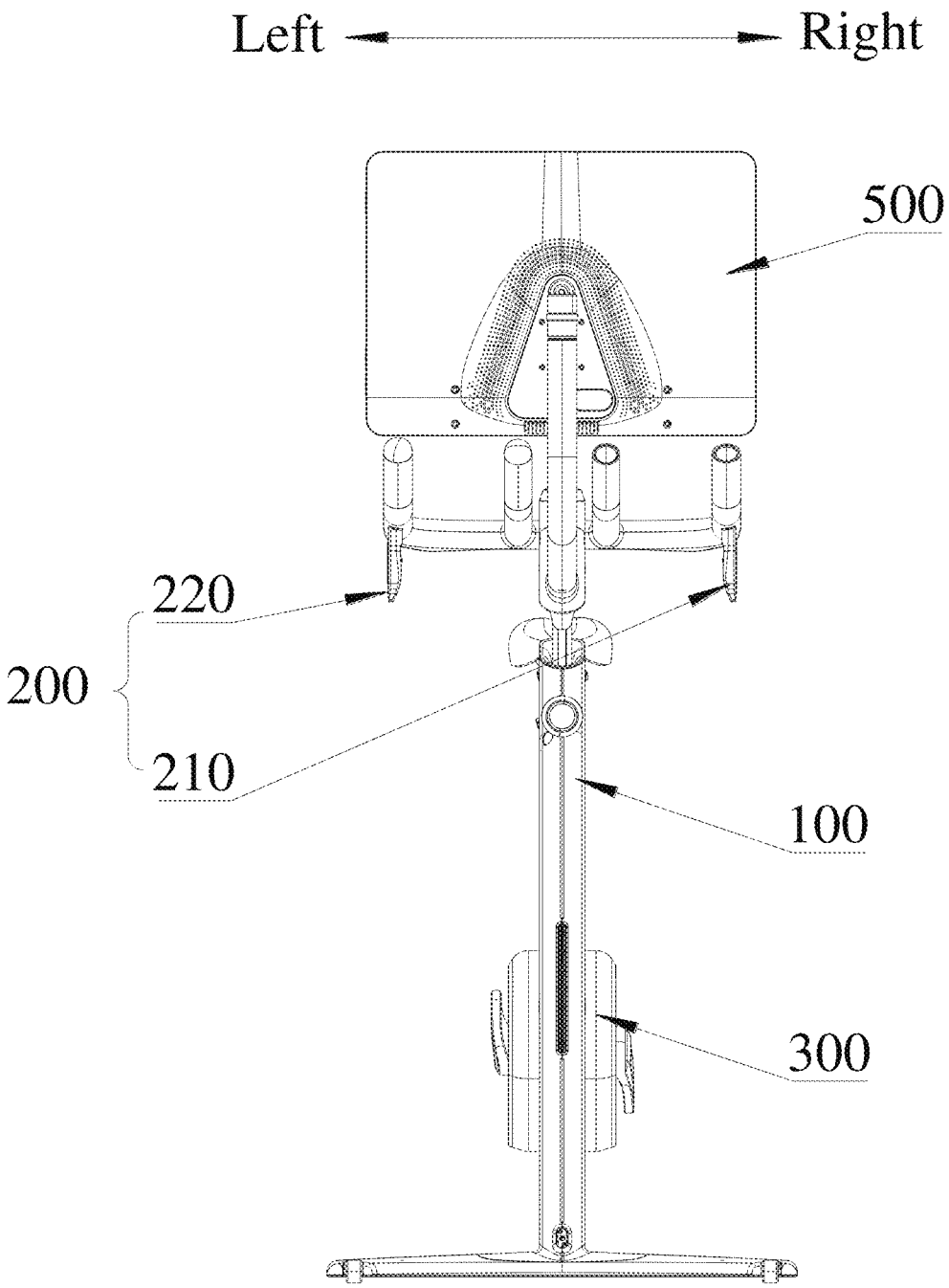
FIG. 3 is a rear view of a fitness bike according to the present disclosure.

To improve the stability of the entire fitness bike and to reduce a probability of rolling over, with continued reference to FIG. 2, a first plane P is defined. Both a support bottom surface of the front leg 122 and a support bottom surface of the rear leg 123 are located in the first plane P. In a direction perpendicular to the first plane P, a projection of the main body 121 of the body in the first plane P is located between the front leg 122 and the rear leg 123.

Further, in the direction perpendicular to the first plane P, a projection of a center of gravity of the drive assembly 300 in the first plane P is P0. Moreover, with continued reference to FIG. 2, a second plane P1 is defined. The second plane P1 passes through the main body 121 of the body and divides the main body 121 of the body into two symmetrical portions, that is, the second plane P1 is a parting surface of the main body 121 of the body. A portion of a projection of the second plane P1 in the first plane P that falls between the front leg 122 and the rear leg 123 is a first line segment AB, P0 is located within the first line segment AB, a length of the first line segment AB is L, and a distance between P0 and a point B is L1, where a ratio of L1 to L is m, and $0.3 \leq m < 0.5$.

In an embodiment of the present application, the electric signal for changing the resistance provided by the load motor 310 is sent to the drive plate 360 for controlling the load motor 310 in the three manners described below.

In a first manner, the user triggers a toggle member 200 to perform the sending. As shown in FIG. 1, the fitness bike further includes a toggle member 200, where one end of the toggle member 200 is movably connected to the handlebar 110, the toggle member 200 can be toggled by a hand gripping on the handlebar 110, and toggling the toggle member 200 can adjust the magnitude of the resistance. It is to be noted that a program for controlling the load motor 310 to change the resistance is disposed in the drive plate 360. The program is the related art, which is not repeated here.

In the fitness bike, the toggle member 200 is disposed on the handlebar 110 so that the toggle member 200 is located in a range that can be touched by a finger of the user when the user rides the fitness bike, and the toggle member 200 can be toggled when the user grips on the handlebar 110, thereby achieving the stepless and continuous adjustment of the magnitude of the resistance provided by the load motor 310. A manner of switching and controlling a transmission of a real bike is simulated in the manner of adjusting the resistance so that the riding experience of the user is more real, thereby improving the riding experience of the user. It is to be noted that a cross exists between a user population that selects the fitness bike as a fitness manner and a user population that selects the real bike as a fitness manner. Therefore, whether riding the fitness bike can bring relatively real experience of riding the real bike directly determines the number of people in the crossing region. Therefore, how to enable the user to obtain near real riding experience when riding the fitness bike is an important improvement direction of the fitness bike.

In some embodiments, the toggle member 200 includes a first shift lever 210 disposed on a first handle 111 and a second shift lever 220 disposed on a second handle 112. The two toggle members 200, namely the first shift lever 210 and the second shift lever 220, are disposed so that the user can control the magnitude of the resistance by using both hands. In addition, the two toggle members 200, namely the first shift lever 210 and the second shift lever 220, are disposed so that controlling two wheels of the real bike can also be simulated. One shift lever can simulate an upshift/downshift for controlling a front wheel of the real bike, and the other shift lever can simulate an upshift/downshift of a rear wheel so that simulation training is close to real riding training. In an embodiment, the first shift lever 210 and the second shift lever 220 are disposed on longitudinal rod portions of a first handle 111 and a second handle 112 that are located on an outermost side, and the longitudinal rod portion may be the above fifth rod portion.

In some embodiments, the first shift lever 210 is an upshift shift lever, and toggling the first shift lever 210 can increase the resistance; the second shift lever 220 is a downshift shift lever, and toggling the second shift lever 220 can decrease the resistance. When the user triggers the upshift shift lever, the upshift shift lever can send an electric signal to the drive plate 360 to control the resistance to increase so that the resistance provided to the user by the load motor 310 gradually increases and the exercise intensity of the user increases. When the user triggers the downshift shift lever, the downshift shift lever can send an electric signal to the drive plate 360 to control the resistance to decrease so that the resistance provided to the user by the load motor 310 gradually decreases and the exercise intensity of the user decreases. How do the upshift shift lever and the downshift shift lever send the electric signals to the drive plate 360 is the related art, which is not described in detail here.

In some parallel embodiments, at least one of the first shift lever 210 and the second shift lever 220 is an upshift/downshift shift lever, where toggling the first shift lever 210 or the second shift lever 220 in a first direction can increase the resistance, and toggling the first shift lever 210 or the second shift lever 220 in a second direction can decrease the resistance. The first direction and the second direction may be any two of a front direction, a rear direction, a left direction, a right direction, an upper direction and a lower direction. Specifically, two cases are described below. In a first case, only one of the first shift lever 210 and the second shift lever 220 is the upshift/downshift shift lever, and the other is a shift lever for controlling other data to change, for example, controlling the lifting of the seat 140 and the lifting of the head 130. In a second case, each of the first shift lever 210 and the second shift lever 220 is the upshift/downshift shift lever. In this manner, the selectivity of the user is improved. Moreover, when one fails, the other can still work normally so that the usage experience of the user is relatively high.

In a second manner, the user triggers a button 400 to perform the sending. In some embodiments, with continued reference to FIG. 1, a button 400 is disposed on the head 130, and pressing the button 400 can change the resistance. Pressing the button 400 can also send a signal to the drive plate 360 to change the resistance. Compared with the stepless and continuous adjustment performed on the resistance by the toggle member 200, the button 400 performs shift adjustment on the resistance. Each shift corresponds to a resistance value, and the number of resistance gears is set according to a requirement.

In some embodiments, the button 400 includes an upshift button and a downshift button, where pressing the upshift button can increase the resistance, and pressing the downshift button can decrease the resistance. In an embodiment, the upshift button and the downshift button are disposed on two sides of the head 130. When the user grips on transverse rod portions of the first handle 111 and the second handle 112 that are located on the outermost side, a thumb can directly click or press the upshift button or the downshift button, and the transverse rod portion may be the above third rod portion.

In some parallel embodiments, the button 400 is a gear cycle button, where pressing the gear cycle button can cyclically change a resistance gear of the load motor 310.

In a third manner, the user triggers a control screen 500 to perform the sending. With continued reference to FIG. 1, the fitness bike further includes a control screen 500, where touching the control screen 500 can change the resistance. In an embodiment, the control screen 500 is connected to the head 130 by a connecting rod 510. In an embodiment, a control icon is displayed on a screen of the control screen 500. Clicking the control icon can run a control program so that the load motor 310 is controlled to achieve a function of adjusting the resistance. In addition, the control screen 500 may adjust the resistance of the load motor 310 through the stepless and continuous adjustment or the shift adjustment. Of course, the control screen 500 may also have both a function of the stepless and continuous adjustment and a function of the shift adjustment.

A motion mode of the fitness bike is adjusted by the control screen 500 so that software can be better combined with hardware. In an embodiment, the control screen 500 is a controller with a display function, and a teaching course can be played on the control screen 500 so that not only can different riding modes such as a mountain bike and a road racing bike be simulated, but also a network coach can be provided to tutor the user to exercise. The control screen 500 matches different course scenarios with different riding modes, and the user can have an immerse training feeling by watching the course on the control screen 500.

In addition, various data of a body of the user in a training process can be displayed and recorded in real-time on the control screen 500. The data can be obtained by a fitness band equipped by the user and various sensors built in the fitness bike. The user can adjust a training action of the user according to the displayed real-time data, thereby ensuring that the user can meet a training requirement according to a course requirement and performing more effective training. Compared with a traditional fitness bike with a flywheel, the fitness bike has better training experience.

It is to be noted that the control screen 500 includes a circuit board, where a control system program of the bike is built in the circuit board. The control system program is the related art. The circuit board is electrically connected to the drive plate 360 disposed in the third accommodation cavity. The drive plate 360 can control the load motor 310 to drive. Wi-Fi and Bluetooth functions exist between the drive plate 360 and the load motor 310, thereby achieving interconnection between the drive plate 360 and the load motor 310. The user can control all functional adjustment functions of the fitness bike by using the control screen 500, for example, the motion mode of the fitness bike and the resistance provided by the load motor 310.

To further improve the usage experience of the user, the fitness bike further includes a virtual apparatus (not shown in the figure), where the virtual apparatus is used for providing a sense scenario that can simulate a riding environment to the user. Since usage scenarios of the fitness bike are mostly indoor and the environment is relatively single, the user feels very tedious after long time usage. Therefore, many users buy fitness bikes and leave the fitness bikes idle. The virtual apparatus can simulate a real riding environment for the user, thereby improving the interest of the fitness bike and improving the usage experience of the user.

In an embodiment, the virtual apparatus includes a VR helmet, and a user wearing the VR helmet can obtain relatively real visual, auditory and other information. In another embodiment, the virtual apparatus includes VR glasses and a display mechanism, where the display mechanism here may be the above control screen 500, and a two-dimensional image displayed on the display mechanism can be adjusted to a three-dimensional image by the VR glasses. In another embodiment, the virtual apparatus includes a VR helmet and a display mechanism, where the VR helmet is communicatively connected to the display mechanism, a game interface can be displayed on the display mechanism, a somatosensory component similar to a game somatosensory handle is disposed on the VR helmet, and game actions are completed by actions such as head nodding and head shaking, thereby achieving an object of exercising a head of the user.

In some embodiments, stepping on the pedals enables the load motor 310 to generate power, and the load motor 310 is electrically connected to the virtual apparatus to supply power to the virtual apparatus. Of course, in addition to supplying power to the virtual apparatus, the load motor 310 can further supply power to other powered devices. For example, the load motor 310 is electrically connected to the control screen 500 to supply power to the control screen 500.

Apparently, the preceding embodiments of the present disclosure are only illustrative of the present disclosure and are not intended to limit the embodiments of the present disclosure. Those of ordinary skill in the art can make various apparent modifications, adaptations and substitutions without departing from the scope of the present disclosure. All embodiments cannot be and do not need to be exhausted herein. Any modifications, equivalent substitutions and improvements made within the spirit and principle of the present disclosure fall within the scope of the claims of the present disclosure As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about", "generally", and "approximately" are intended to cover variations that may exist in the upper and lower limits of the ranges of subjective or objective values, such as variations in properties, parameters, sizes, and dimensions. In one non-limiting example, the terms "about", "generally", and "approximately" mean at, or plus 10 percent or less, or minus 10 percent or less. In one non-limiting example, the terms "about", "generally", and "approximately" mean sufficiently close to be deemed by one of skill in the art in the relevant field to be included. As utilized herein, the term "substantially" refers to the complete or nearly complete extent or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way that enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A fitness bike, comprising:

a frame comprising a handlebar and a body;

a toggle member, wherein one end of the toggle member is movably connected to the handlebar, and the toggle member is operable to be toggled by a hand gripping on the handlebar; and a drive assembly disposed on the body and comprising a load motor, a transmission mechanism, and pedals, wherein a motor shaft of the load motor is drivingly connected to the pedals via the transmission mechanism;

wherein the motor shaft is driven to rotate by stepping on the pedals, the load motor is configured to provide resistance, and the resistance is operable to be adjusted by toggling the toggle member;

wherein the transmission mechanism comprises a first multi-wedge wheel, a second multi-wedge wheel and a multi-wedge belt, the motor shaft is drivingly connected to the first multi-wedge wheel, the pedals are drivingly connected to the second multi-wedge wheel, and the multi-wedge belt is sleeved on the first multi-wedge wheel and the second multi-wedge wheel;

wherein the drive assembly further comprises a tensioning mechanism, the tensioning mechanism comprises a tensioning wheel, a tensioning bolt and a rotary connector, one end of the rotary connector is capable of rotating about a first axis, the tensioning wheel is connected to the rotary connector and is pressed against an outer side of the multi-wedge belt, and the tensioning bolt is operable to be pressed against the rotary connector.

2. The fitness bike according to claim 1, wherein the handlebar comprises a first handle and a second handle, wherein the toggle member comprises a first shift lever disposed on the first handle and a second shift lever disposed on the second handle.

3. The fitness bike according to claim 2, wherein the first shift lever is an upshift shift lever, and the resistance is increased by toggling the first shift lever; and the second shift lever is a downshift shift lever, and the resistance is decreased by toggling the second shift lever.

4. The fitness bike according to claim 2, wherein at least one of the first shift lever and the second shift lever is an upshift/downshift shift lever, wherein the resistance is increased by toggling the first shift lever or the second shift lever being the upshift/downshift shift lever in a first direction, and the resistance is decreased by toggling the first shift lever or the second shift lever being the upshift/downshift shift lever in a second direction.

5. The fitness bike according to claim 1, wherein the drive assembly further comprises a mounting member, wherein an arc-shaped guide recess is disposed on one of the mounting member and the rotary connector, a guide protrusion is disposed on another of the mounting member and the rotary connector, and the guide protrusion is capable of moving in the arc-shaped guide recess.

6. The fitness bike according to claim 1, wherein the drive assembly further comprises a mounting member, wherein a movable guide seat is fixed on the mounting member, and the tensioning bolt is movably inserted through the movable guide seat.

7. The fitness bike according to claim 1, wherein the fitness bike satisfies at least one of:

the frame further comprises a head, wherein a button is disposed on the head, and the resistance is operable to be adjusted by pressing the button; or the fitness bike further comprises a control screen, wherein the resistance is operable to be adjusted by touching the control screen.

8. The fitness bike according to claim 7, wherein the button comprises an upshift button and a downshift button, wherein the resistance is operable to be increased by pressing the upshift button, and the resistance is operable to be decreased by pressing the downshift button; or the button is a gear cycle button, and a resistance gear of the load motor is operable to be cyclically changed by pressing the gear cycle button.

9. The fitness bike according to claim 2, wherein the fitness bike satisfies at least one of:

the frame further comprises a head, wherein a button is disposed on the head, and the resistance is operable to be adjusted by pressing the button; or the fitness bike further comprises a control screen, wherein the resistance is operable to be adjusted by touching the control screen.

10. The fitness bike according to claim 3, wherein the fitness bike satisfies at least one of:

the frame further comprises a head, wherein a button is disposed on the head, and the resistance is operable to be adjusted by pressing the button; or the fitness bike further comprises a control screen, wherein the resistance is operable to be adjusted by touching the control screen.

11. The fitness bike according to claim 4, wherein the fitness bike satisfies at least one of:

the frame further comprises a head, wherein a button is disposed on the head, and the resistance is operable to be adjusted by pressing the button; or the fitness bike further comprises a control screen, wherein the resistance is operable to be adjusted by touching the control screen.

12. The fitness bike according to claim 1, wherein the fitness bike satisfies at least one of:

the frame further comprises a head, wherein a button is disposed on the head, and the resistance is operable to be adjusted by pressing the button; or the fitness bike further comprises a control screen, wherein the resistance is operable to be adjusted by touching the control screen.

13. The fitness bike according to claim 1, wherein the fitness bike satisfies at least one of:

the frame further comprises a head, wherein a button is disposed on the head, and the resistance is operable to be adjusted by pressing the button; or the fitness bike further comprises a control screen, wherein the resistance is operable to be adjusted by touching the control screen.

14. The fitness bike according to claim 5, wherein the fitness bike satisfies at least one of:

the frame further comprises a head, wherein a button is disposed on the head, and the resistance is operable to be adjusted by pressing the button; or the fitness bike further comprises a control screen, wherein the resistance is operable to be adjusted by touching the control screen.

15. The fitness bike according to claim 6, wherein the fitness bike satisfies at least one of:

the frame further comprises a head, wherein a button is disposed on the head, and the resistance is operable to be adjusted by pressing the button; or the fitness bike further comprises a control screen, wherein the resistance is operable to be adjusted by touching the control screen.

* * * * *